United States Patent [19]

Brunner

[11] Patent Number: 4,955,667

[45] Date of Patent: Sep. 11, 1990

[54] SEATING IN THE FORM OF A CHAIR OR SIMILAR PIECE OF FURNITURE

[75] Inventor: Rolf Brunner, Rheinau-Helmlingen, Fed. Rep. of Germany

[73] Assignee: Brunner GmbH, Rheinau-Freistett, Fed. Rep. of Germany

[21] Appl. No.: 398,245

[22] Filed: Aug. 24, 1989

[30] Foreign Application Priority Data

Aug. 25, 1988 [DE] Fed. Rep. of Germany ..... 3828808

[51] Int. Cl.[5] ..... A47C 1/12

[52] U.S. Cl. ..... 297/446; 297/445

[58] Field of Search ..... 297/445, 446, 452; 108/152; 403/232.1, 192, 200, 187; 248/188.7

[56] References Cited

U.S. PATENT DOCUMENTS

| | | | |
|---|---|---|---|
| 820,689 | 5/1906 | Wilmot | 297/445 X |
| 874,203 | 12/1907 | Jackson | 297/445 X |
| 3,323,656 | 6/1967 | Weiss et al. | 108/152 X |
| 3,359,990 | 8/1967 | Giacomini | 248/189.91 X |
| 4,119,286 | 10/1978 | Barril | 297/445 |
| 4,676,552 | 6/1987 | Hiller | 297/445 |
| 4,850,647 | 7/1989 | Engel | 297/445 X |

*Primary Examiner*—Peter A. Aschenbrenner
*Attorney, Agent, or Firm*—Max Fogiel

[57] ABSTRACT

Seating in the form of a chair or similar piece of furniture. The legs are connected by a frame. The frame is a torsionally rigid box with a top and bottom connected and prevented from shifting in relation to each other by lateral stretchers. In addition to connecting the legs, the frame constitutes a support for a seat. The lateral stretchers of the frame in one practical embodiment are arcs of a circle with their ends merging into corners. The legs are rigidly secured to the frame in the vicinity of the corners.

9 Claims, 2 Drawing Sheets

SEATING IN THE FORM OF A CHAIR OR SIMILAR PIECE OF FURNITURE

Figure 1:
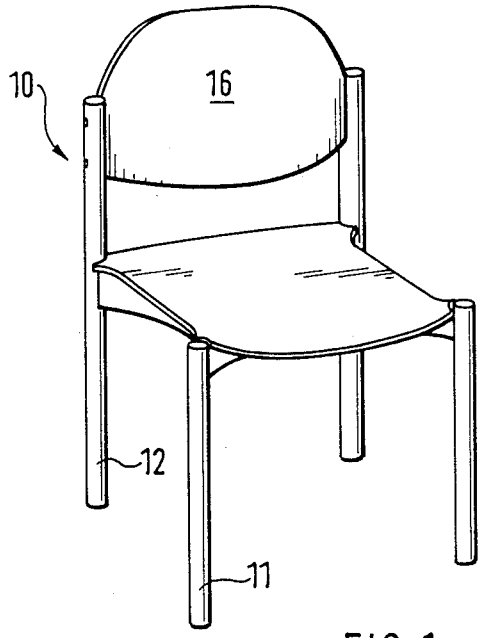

The invention concerns a chair or similar piece of furniture with at least three legs and a frame, to which the legs are attached and which acts as a support for a seat, in the vicinity of the seating plane.

A chair with a frame that is accommodated between and connects its legs while simultaneously acting as a support for a seat is known (although not capable of documentation from published literature). The frame in this known chair consists of stretchers glued together at the corners and each extending between adjacent legs. The abutting and glued-together ends of the stretchers are mitered at approximately 45° to their overall length and glued in the form of tenons into matching transverse mortises in the legs.

Although the frame in chairs of this type is made out of either solid or multilaminated wood that is thick enough to provide adequate stability, it is still not satisfactorily torsionally rigid. A chair with a frame of this type is also of course very heavy, which is a particular drawback when it is intended for stacking.

The object of the present invention is accordingly to provide a chair or similar piece of furniture that will exhibit considerable torsional rigidity, that will support considerable weight, and that will be perceptibly less heavy than the known chair.

This object is attained in accordance with the invention in a chair as recited in the preamble to claim 1 in that the frame that connects the legs is a box with a top and bottom connected and prevented from shifting in relation to each other by lateral stretchers.

The point of the invention is accordingly to replace the frame that exists in the known chair of glued-together stretchers that are considerably thick with a box-like frame with sides and a top and bottom that do not need to be thick. In spite of the thin material, however, the hollow, box-like frame in accordance with the invention can bear a lot of weight and is in particular torsionally rigid and not very heavy.

The stretchers and/or top and bottom of the frame in one practical embodiment can consist of laminated wood with several layers of glue. Since the frame is a box that is closed off at the top and bottom, accordingly, the laminated wood can be thin. It can in particular be plywood.

The frame in another practical embodiment can be a polygon with as many sides as there are legs, with a stretcher extending between each pair of adjacent legs, and with the stretchers rigidly secured together at the corners, where the legs are attached.

Each stretcher in a further development of this embodiment can be at least approximately in the shape of an arc of a circle that curves in toward the center of the seat between each pair of adjacent legs, whereby the adjoining ends of the adjacent stretchers rest against each other like the points of a star and are joined surface to surface.

A plywood reinforcing insert can be positioned between the adjoining ends of each pair of adjacent stretchers and secured, especially glued, to the ends of the stretchers in this version.

The legs in another embodiment of the piece of furniture can be secured to the frame by irons on their inner surface. It has been proven practical for the irons to be lengths of U-shaped structural section with a web that rests against its associated leg and with flanks that overlap the top and bottom of the frame in the vicinity of the corners shaped like the points of a star. The result is a torsionally rigid joint between each corner of the frame and its associated iron and, by way of the latter, with its associated leg.

The surface of the web that faces the flanks of each iron in another version of this embodiment can be a pocket that is demarcated by lateral areas and that accommodates the end of the adjacent corner.

Figure 2:
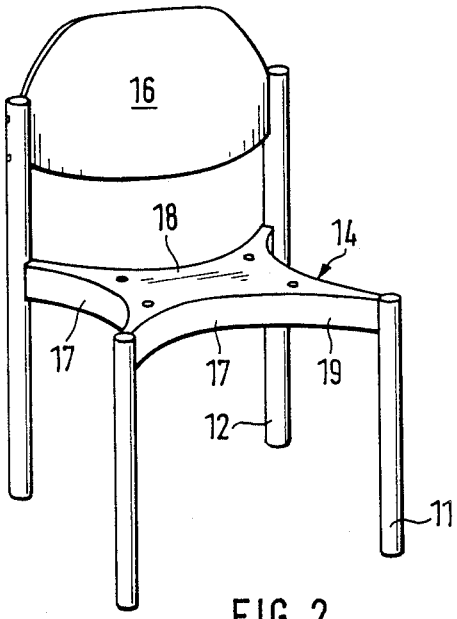
Figure 3:
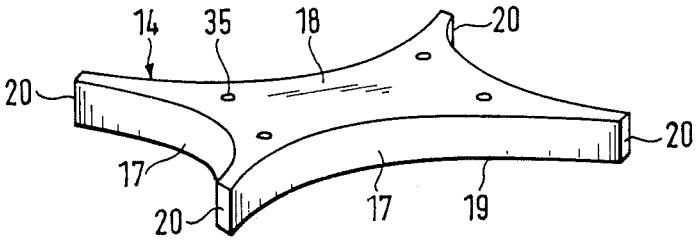
Figure 4:
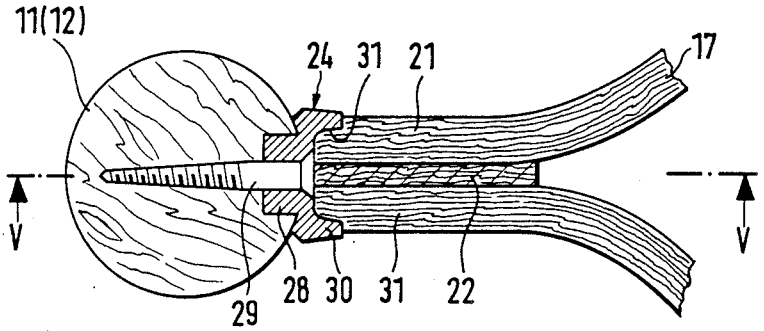
Figure 5:
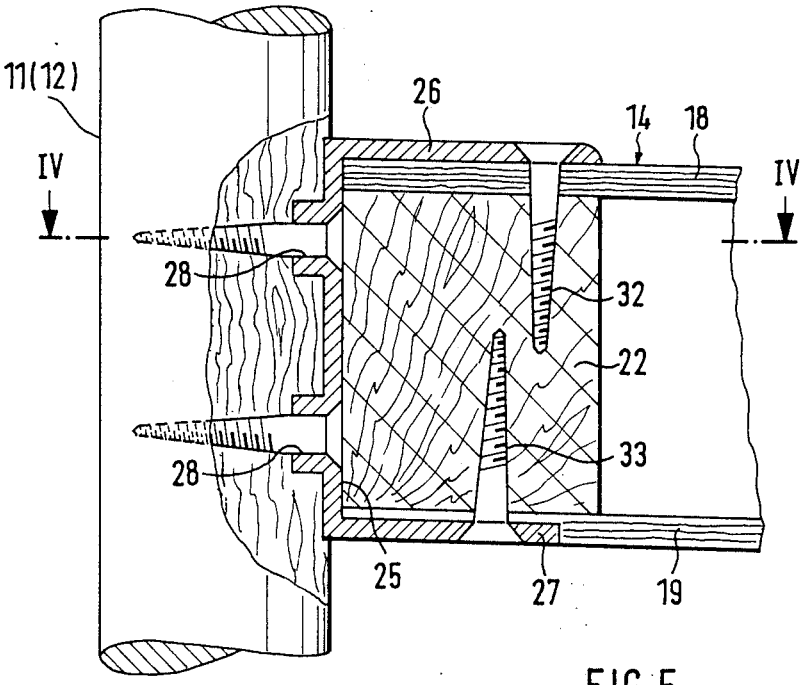

One embodiment of the invention will now be described with reference to the schematic views in the attached drawing, wherein FIG. 1 is an overall perspective view of a chair in accordance with the invention, FIG. 2 is a perspective view of the chair illustrated in FIG. 1 without its seat, FIG. 3 is a slightly larger-scale perspective view of the frame that connects the legs by itself, FIG. 4 is a large-scale horizontal section along the line IV—IV in FIG. 4 through the corner of a box-shape frame with a leg secured to it by an iron, and FIG. 5 is a vertical section along the line V—V in FIG. 3 through the corner of the frame with a leg secured to it.

The chair 10 illustrated in FIGS. 1 and 2 is a stacking chair with two front and two rear legs 11 and 12 connected by a box-shaped frame 14. The frame, in addition to acting as a torsionally rigid connector for the legs, also constitutes a support for a seat 15 that is secured in a way that is of no further interest in the present context. Whereas front legs 11 terminate at the level of the seat, rear legs 12 continue up above it and accommodate between them a back 16.

Frame 14 comprises four lateral stretchers 17, a top 18, and a bottom 19. The stretchers are circular arcs of multiply glued laminated wood that terminate in four corners 20 shaped like the points of a star and curve in between them, below the seat of the finished chair. The ends 21 of each pair of adjacent stretchers 17 merge in the vicinity of the corners 20 of frame 14 into parallel sections and are glued together by way of an intermediate reinforcing plywood insert 22. Top 18 and bottom 19 are glued, in such a way that they cannot shift in relation to each other, to the upper and lower edges of the stretchers 17 that create a star-shaped frame. The top and bottom extend to the corners 20 that unite legs 11 and 12 to the frame.

Frame 14 is a light-weight and hollow component that is very torsionally rigid. Its stretchers 17, top 18, and bottom 19 are very thin and can for example be made of plywood.

In the vicinity of each corner 20 of frame 14, reinforced by the glued-in insert 22 between the ends of adjacent stretchers 17, a leg 11 or 12 is secured to the frame by an iron 24.

The irons are lengths of diecast U-shaped structural section and have a web 25 that rests against its associated leg and upper and lower flanks 26 and 27 that are separated by the web and extend out of the surface of the iron that faces away from the leg. The flanks overlap the top and bottom of frame 14 in the vicinity of each corner 20. Whereas upper flank 26 rests against top 18, lower flank 27 is recessed into bottom 19 to facilitate stacking chair 10 and is accordingly level with its surface.

The webs 25 that rest against legs 11 and 12 are concave, matching the inner contour of the legs, and are provided with separated collars 28 that extend into matching bores in the legs and secured to the legs by screws 29 that are countersunk into and extend through the collars. On the other side of web 25, a groove-like pocket 31, demarcated by lateral areas 30, extends between the two flanks 26 and 27 of iron 24. This pocket is mechanically engaged by the associated end, which matches the shape of the pocket, of each corner of the frame.

The flanks 26 and 27 extending out of the surface of the web in each iron 24 that faces away from the stool and resting against the top 18 and bottom 19 of the frame are glued to the top and bottom and secured by schematically illustrated screws 32 and 33. The ends of the star-point corners 20 of frame 14 are also cemented and forced into the groove-like pocket 31 in each iron.

Frame 14, which is in the form of a hollow and torsionally rigid box, is accordingly secured torsionally rigid to the legs by iron 24 in the vicinity of the corners 20 constituted by the glued-together ends of stretchers 17.

The top 18 of the illustrated embodiment of frame 14 has four holes 35 symmetrically distributed over its surface. Projections in matching positions on the bottom of seat 15 extend securely into these holes and can be extracted from them. The projections are not illustrated.

I claim:

1. A seating arrangement comprising: a chair with at least three legs and a holding frame; said legs being attached to said holding frame; said holding frame being a support for a seat in vicinity of a seating plane; said holding frame comprising a box-shaped frame having a top plate member and a bottom plate member, spaced from said top plate member; and side members connecting fixedly edges of said top plate member and edges of said bottom plate member to prevent shifting of said top plate member and said bottom plate member relative to each other.

2. A seating arrangement as defined in claim 1, wherein at least one of said top plate member, said bottom plate member, and said side members, comprise laminated wood with a plurality layers of wood.

3. A seating arrangement as defined in claim 1, wherein said holding frame comprises a polygon with a number of sides equal to the number of legs; a side member extending between each pair of adjacent legs; said polygon having corners, said side members being rigidly secured together at said corners; said legs being attached at said corners.

4. A seating arrangement as defined in claim 3, wherein each side members has substantially at least the shape of an arc of a circle curving in toward the center of the seat between each pair of adjacent legs; adjoining ends of adjacent side members resting against each other as points of a star and being joined surface to surface.

5. A seating arrangement as defined in claim 3, including a plywood reinforcing insert, ends of each pair of adjacent side members being secured together by glue with said plywood reinforcing insert between said adjacent side members.

6. A seating arrangement as defined in claim 1, including iron elements for securing said legs to said holding frame on inner surfaces of said legs.

7. A seating arrangement as defined in claim 6, wherein said iron elements have a u-shaped structural section with a web resting against the respective leg, said structural section having flanks overlapping said top plate member and said bottom plate member of said holding frame in vicinity of corners of said holding frame, said corners being shaped as points of a star.

8. A seating arrangement as defined in claim 7, wherein said web has a surface facing said flanks of each iron element as a pocket demarcated by lateral areas and accommodates an end of the adjacent corner of said holding frame.

9. A seating arrangement comprising: a chair with at least three legs and a holding frame; said legs being attached to said holding frame; said holding frame being a support for a seat in vicinity of a seating plane; said holding frame comprising a box-shaped frame having a top plate member and a bottom plate member, spaced from said top plate member; and side members connecting fixedly edges of said top plate member and edges of said bottom plate member to prevent shifting of said top plate member and said bottom plate member relative to each other; at least one of said sides members, top plate member, and bottom plate member comprising laminated wood with a plurality of layers of glue; said holding frame being a polygon with a number of sides equal to the number of legs, a side member extending between each pair of adjacent legs, said polygon having corners attached to said legs, said side members being rigidly secured together at said corners; each side member being at least substantially in shape of an arc of a circle curving in toward the center of the seat between each pair of adjacent legs, adjacent side members having adjoining ends resting against each other as points of a star and being joined surface to surface; ends of each pair of adjacent side members being secured together by glue, a plywood reinforcing insert being located between said pair of adjacent side members; iron elements securing said legs to said holding frame on inner surfaces of said legs; said iron elements having a u-shaped structural section with a web resting against the respective leg, said structural section having flanks overlapping said top plate member and said bottom plate member of said holding frame in vicinity of corners of said holding frame shaped as points of a star; said web having a surface facing said flanks of each iron element as a pocket demarcated by lateral areas and accommodating an end of an adjacent corner of said holding frame.

* * * * *